United States Patent [19]

Muller

[11] Patent Number: 4,566,593

[45] Date of Patent: Jan. 28, 1986

[54] CARTON FORMED FROM A PLURALITY OF PACKAGES

[75] Inventor: Rolf Muller, Mehring, Fed. Rep. of Germany

[73] Assignee: The Mead Corporation, Dayton, Ohio

[21] Appl. No.: 693,713

[22] Filed: Jan. 23, 1985

[30] Foreign Application Priority Data

Jan. 23, 1984 [GB] United Kingdom ..... 8401658

[51] Int. Cl.[4] ..... B65D 5/54

[52] U.S. Cl. ..... 206/611; 206/434; 206/613; 206/634; 206/820; 229/40

[58] Field of Search ..... 206/144, 613, 427, 428, 206/429, 434, 611, 628, 634, 820, 606, 602, 605, 627, 631; 229/40

[56] References Cited

U.S. PATENT DOCUMENTS

| | | | |
|---|---|---|---|
| 3,021,001 | 2/1962 | Donofmo | 206/611 X |
| 3,181,727 | 5/1965 | Graser et al. | 229/40 |
| 3,263,807 | 8/1966 | Fingerhut | 206/605 |
| 4,077,516 | 3/1978 | Duerr | 206/602 |
| 4,151,916 | 5/1979 | Eriksson | 206/628 X |
| 4,424,901 | 1/1984 | Lanier | 206/434 |
| 4,449,633 | 5/1984 | Johnson et al. | 206/612 |

FOREIGN PATENT DOCUMENTS

| | | | |
|---|---|---|---|
| 2447872 | 10/1980 | France | 206/434 |

*Primary Examiner*—Allan N. Shoap
*Assistant Examiner*—Bryon Gehman
*Attorney, Agent, or Firm*—Erwin Doerr

[57] ABSTRACT

A unitized shipping and display carton comprising a plurality of packages ($Pb^1$, $Pb^2$), each having a top wall (16) and a base (12,20) interconnected by a pair of spaced side walls (14,18) so as to form a tubular structure, end wall means (30,32,38,40) to prevent endwise movement of the contents through the ends of said tubular structure, an opening panel (86) provided in the top wall and partially in at least one of the side walls and defined by tear lines. The packages are joined one to the next in side-by-side relationship by side wall portions of the opening panel. Tear lines (x,y) defining a top wall portion are in registry with those of the next adjacent package whereby removal of the opening panel of an endmost package of the carton can be continued to cause removal of the opening panel of the other packages in the carton.

6 Claims, 9 Drawing Figures

CARTON FORMED FROM A PLURALITY OF PACKAGES

This invention relates to a unitized shipping and display carton formed from a plurality of packages joined one to the next and is particularly suitable for the packaging of cans. Each package incorporates easy opening panels to provide access to the contents thereof.

The invention provides a carton comprising a plurality of packages which may be of the wrap-around type, each having a top wall and a base interconnected by a pair of spaced side walls so as to form a tubular structure, end wall means to prevent endwise movement of the contents through the ends of said tubular structure, an opening panel provided partially in said top wall and partially in at least one of said side walls and defined by tear lines, characterised in that said packages are joined one to the next in side by side relationship at least along the side wall portions of said opening panel and in that said tear lines defining a top wall portion of the opening panel of one package are in registry with those of the next adjacent package whereby removal of the opening panel of an endmost package of said carton can be continued to cause removal of the opening panel of the other packages in said carton.

According to a feature of the invention the end wall means may incorporate a carrying handle at one or both ends of the package.

Three embodiments of the invention will now be described, by way of example, with reference to the accompanying drawings in which.

Figure 1:
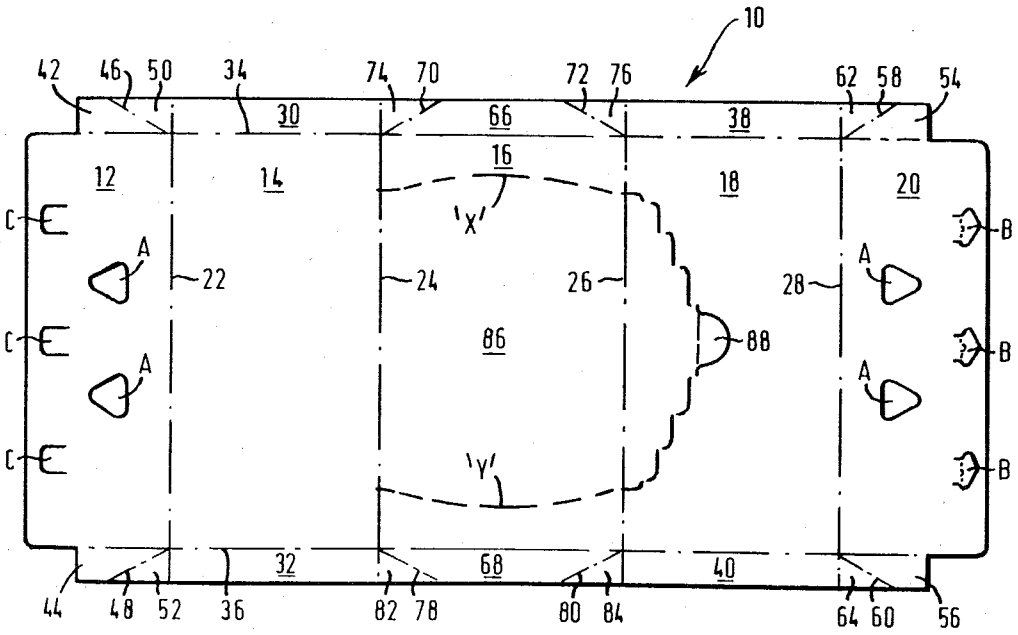
FIG. 1 is a plan view of a blank for forming one type of a package according to the invention.
Figure 2:
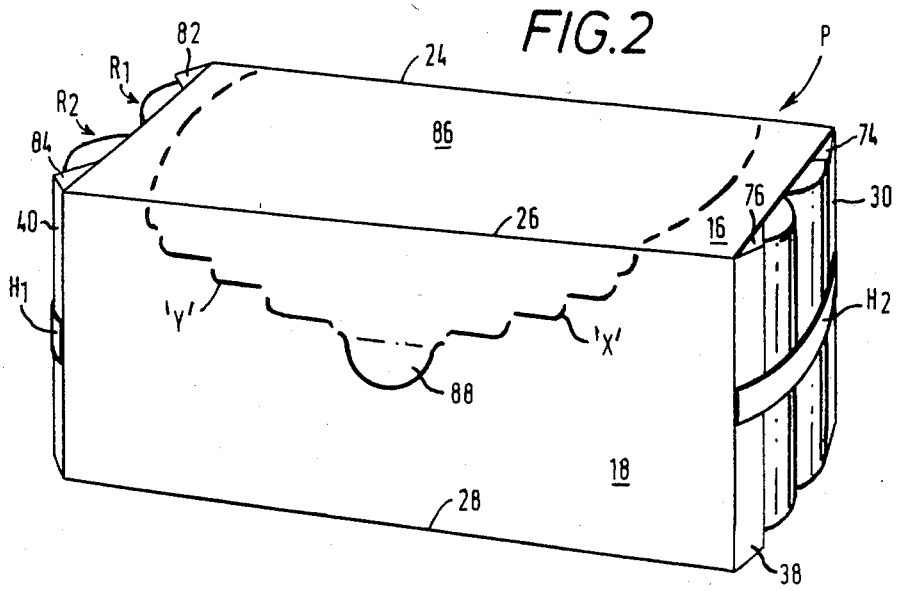
FIG. 2 is a perspective view of a package formed from the blank shown in FIG. 1.
Figure 3:
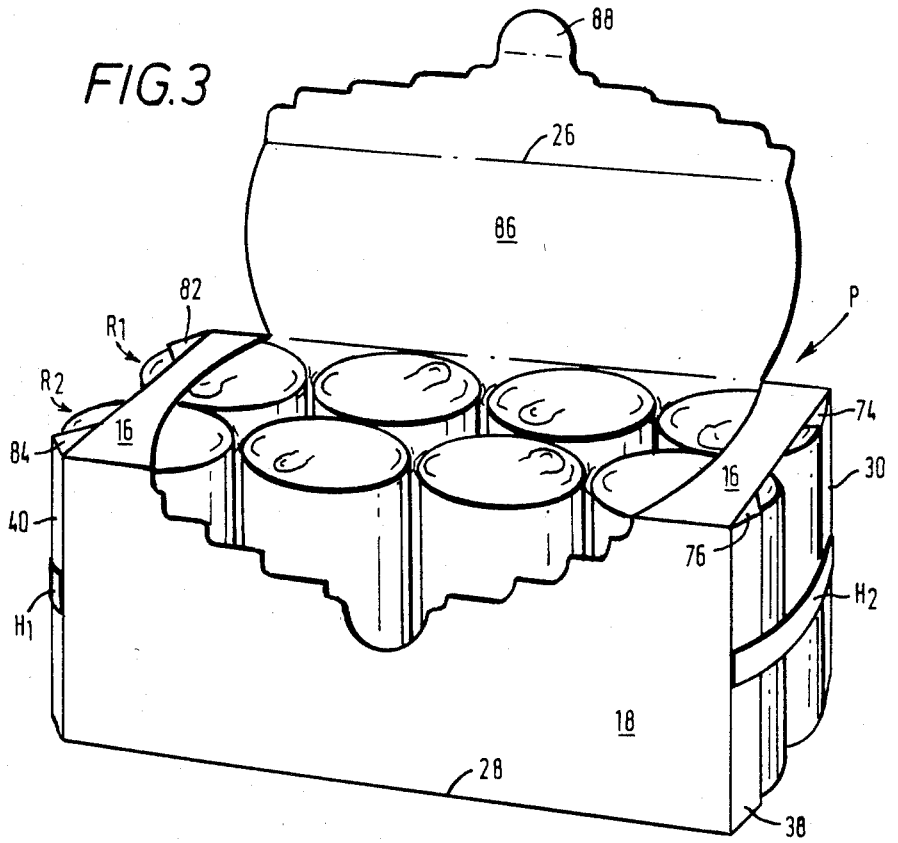
FIG. 3 is a perspective view of the package of FIG. 2 which is opened to provide access to the contents.

Referring first to FIGS. 1 to 3 of the drawings, there is shown an elongate wrapper blank 10 formed from paperboard or similar foldable sheet material for forming the package 'P'. The blank 10 comprises in series a first base or lap panel 12, a first side wall panel 14, a top panel 16, a second side wall panel 18 and a second lap panel 20, hinged one to the next along transverse fold lines 22,24,26,28 respectively.

The side wall panel 14 includes an integral end panel 30 and 32 hinged to each of its opposite longitudinal edges along longitudinal fold lines 34 and 36 respectively. Similarly, side wall panel 18 includes integral end panels 38 and 40 hinged to each of its opposite longitudinal edges along the longitudinal fold lines 34 and 36 respectively.

Tuck flaps 42 and 44 are integrally hinged to the opposite longitudinal edges of lap panel 12 at fold lines 34 and 36, respectively and incorporate oblique fold lines 46 and 48, respectively. These fold lines define adjacent gusset panels 50 and 52 which are integral with the end panels 30 and 32 respectively. Similarly, tuck flaps 54 and 56 are integrally hinged to the opposite longitudinal edges of lap panel 20 at fold lines 34 and 36 respectively, and incorporate oblique fold lines 58 and 60 respectively. These fold lines define adjacent gusset panels 62 and 64 which are integral with the end panels 38 and 40 respectively.

A further set of tuck flaps 66 and 68 are integrally hinged to the opposite longitudinal edges of top panel 16 at fold lines 34 and 36 respectively. The tuck flap 66 incorporates oblique fold lines 70 and 72' defining adjacent gusset panels 74 and 76 integral with end panels 30 and 38, respectively. Likewise, tuck flap 68 incorporates oblique fold lines 78 and 80 defining adjacent gusset panels 82 and 88 integral with end panels 32 and 40 respectively.

As is well known, machine tightening apertures 'A' are formed in the lap panels 12 and 20 and locking tabs 'B' are formed in lap panel 20 for insertion into locking apertures defined by tabs 'C' in lap panel 12 when the lap panels are brought into overlapping relationship during formation of the package.

A hinged lid 86 is provided partially by top panel 16 and partially by side panel 18 in order to allow access to the contents of the package. The lid 86 is defined by tear lines 'x' and 'y' which terminate at one end along the hinge provided by transverse fold line 24 and at the other end they converge to terminate in pull tab 88.

In order to form the package illustrated in FIG. 2, the blank 10 is wrapped about a group of articles, in this case a group of eight cans 'T' arranged in two parallel rows $R^1$ and $R^2$ of four cans each. Thus the top panel 16 lies flat across the tops of the cans, the side panels 14 and 18 extend downwardly adjacent the sides of the cans in rows $R^1$ and $R^2$ and the lap panels 12 and 20 are locked together in overlapping relationship beneath the bases of the cans. During the wrapping process the end panels 30,38 and 32,40 are folded about longitudinal fold lines 34,36 and also about their respective oblique fold lines 46,70:72,58 and 48,78:80,60, respectively. Thus the gusset panels 50,74:76,62 and 52, 82:84,64 permit the end panels 30, 38 and 32,40 to adopt the outwardly inclined positions shown in which they conform closely to the contours of the adjacent can walls in rows $R^1$ and $R^2$. The tuck panels 66,68 are folded into overlapping relationship with and beneath top panel 16.

Hence, the end panels at each end of the package prevent endwise movement of the cans and thereby prevent the cans from dislodgment from the otherwise open ends of the package.

In order better to retain the end panels in their desired position and so as to provide a carrying handle for the package, handle strips $H^1$ and $H^2$ which may be made of plastics material are secured across one or both ends of the package intermediate the top and lap panels. The handle strips may be adhered to the internal or external (as shown) surfaces of the end panels at each end of the package.

To provide access to the contents of the package the lid 86 is opened by grasping the pull tab 88 and pulling upwardly so that the lid tears along tear lines 'x' and 'y'. The package thus opened is shown in FIG. 3.

Figure 4:
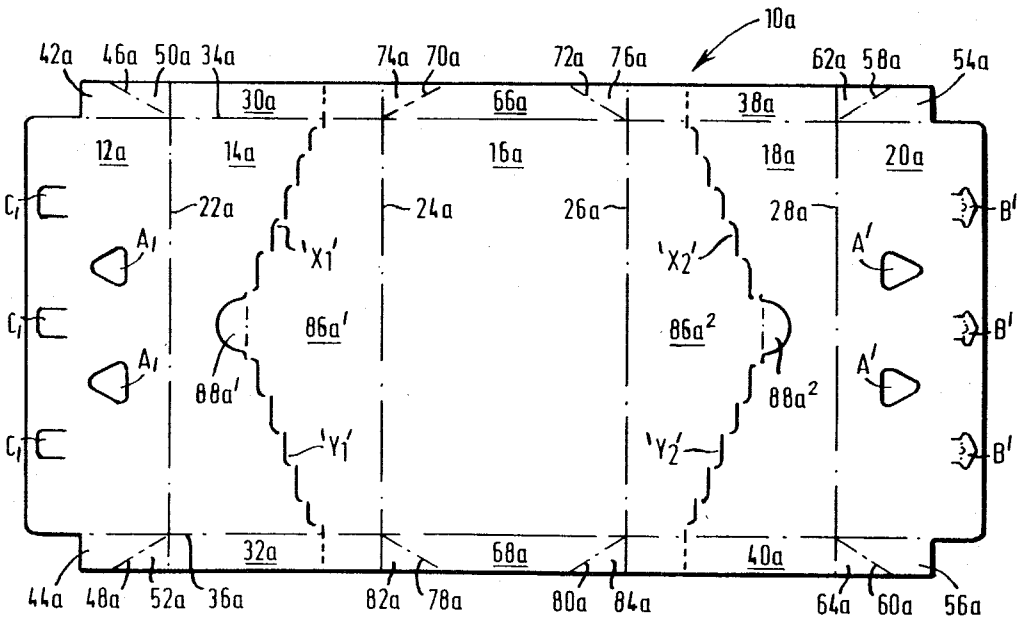
FIG. 4 is a plan view of a wrapper blank for forming another type of a package according to the invention.
Figure 5:
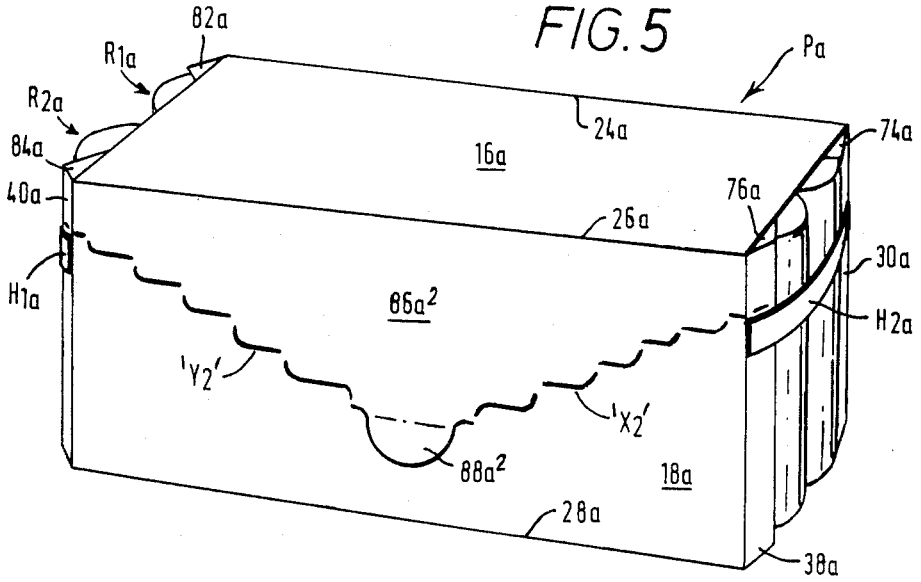
FIG. 5 is a perspective view of a package formed from the blank shown in FIG. 4.
Figure 6:
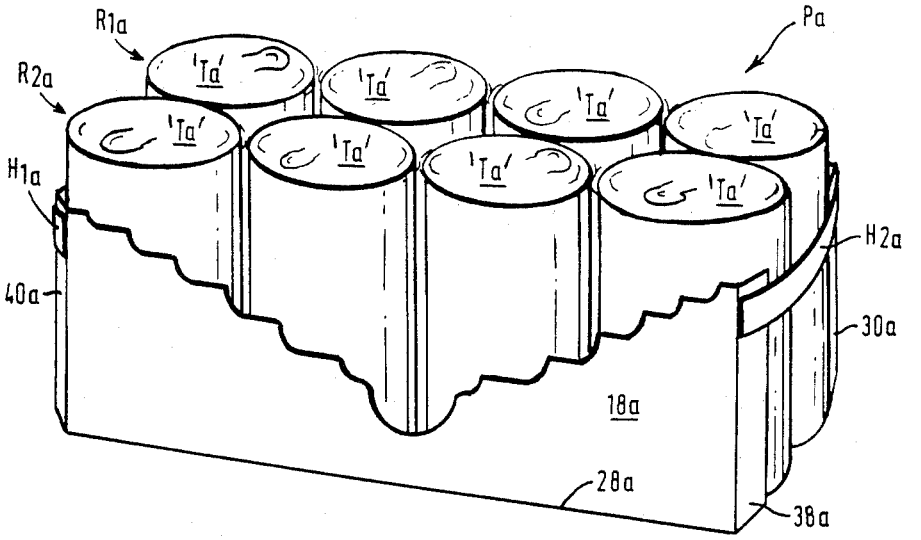
FIG. 6 is a perspective view of the package of FIG. 5 which is opened to provide access to the contents.

The embodiment illustrated in FIGS. 4 to 6 show a modified version of the wrapper blank and package similar to that described above, in which like reference numerals designate like parts with the addition of suffix 'a'. However, in this modified embodiment the hinged lid 86 is substituted by two tear-away panels 86*a*[1] and 86*a*[2], respectively. The tear lines $x^1$, $y^1$ of panel 86*a* terminate at the respective longitudinal edges of the blank 10*a* within the end panels 38*a* and 40*a* respectively.

Thus, in order to open the modified package the pull tabs 88*a*[1] and 88*a*[2] are grasped and pulled so that panels 86*a*[1] and 86*a*[2] tear along their respective 'x–y' tear lines. Hence, the whole of both panels 88*a*[1] and 88*a*[2] together with the top panel and parts depending therefrom are removed so as to expose completely the top portion of the package (FIG. 6).

Figure 7:
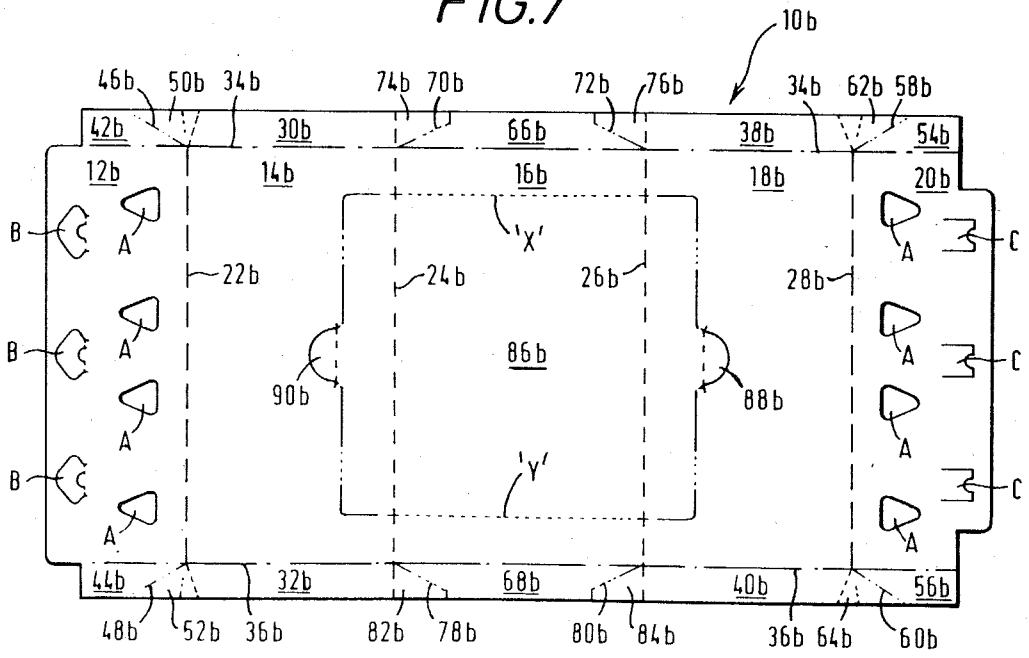
FIG. 7 is a plan view of a wrapper blank for forming yet another type of a package according to the invention.
Figure 8:
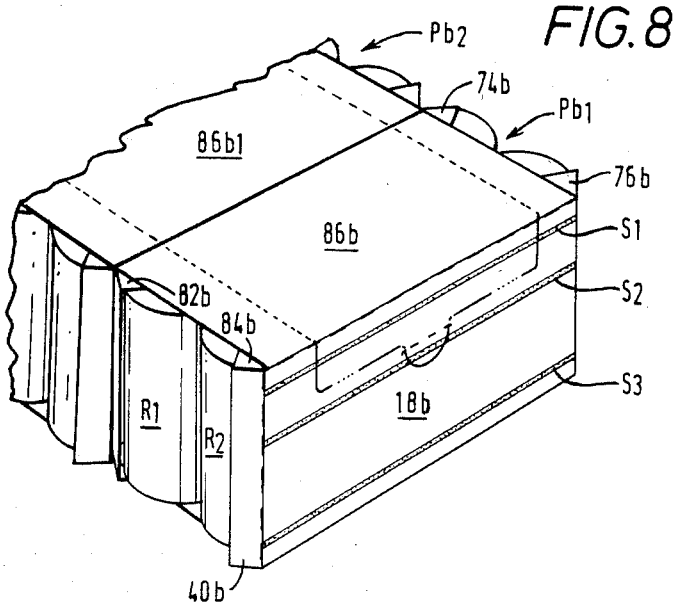
FIG. 8 is a perspective view of a pair of packages connected together in side by side relationship each being formed from the wrapper blank shown in FIG. 7.
Figure 9:
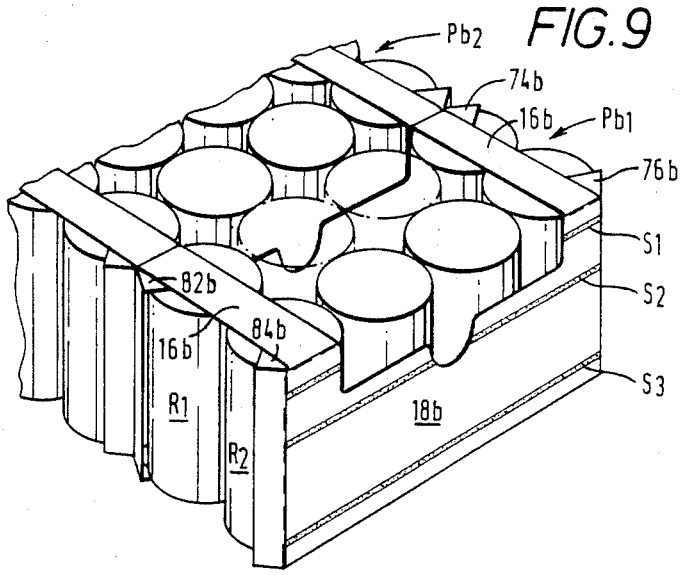
FIG. 9 is a perspective view of the packages shown in FIG. 8 but which are opened to provide access to their contents.

The embodiment shown in FIGS. 7 to 9 shows a modified version of the wrapper blank and package similar to that described with reference to FIGS. 1 to 3 and in which like parts are designated like reference numerals with the addition of suffix 'b'. However, in this modified blank, the hinged lid resembles that of the blank 10*a* in that it is arranged to be completely removed from the package. To this end, the tear lines 'x' and 'y' form a rectangle extending over parts of the top panel 16*b* and both side wall panels 14*b* and 18*b*. A further pull tab 90*b* is provided in side wall 14*b*.

Referring to FIGS. 8 and 9, the package Pb, formed from the blank 10*b* is suitable for attachment to a like package $Pb^2$. The packages are secured together by applying spaced strips $S^1$–$S^3$ of adhesive to the adjacent side walls of the package. As shown, two of the strips $S^1$ and $S^2$ pass along the tear away top panel 86*b* of the package. Thus, when the top panel 86*b* of package $Pb^1$ is grasped and torn, it carries away with it the like tear away tops of the adjoining packages. Hence, in this manner two or more packages may be connected one to the next and openable in a single operation to provide a large capacity multipack.

The packages referred to with reference to FIGS. 1 to 3 and with reference to FIGS. 4 to 6 may also be secured one to the next in side-by-side relationship as described in relation to FIGS. 8 and 9.

While the individual packages described above are of the wrap-around type, it will be understood that this invention is not limited thereto. A variety of other arrangements are suitable and may be used, for example, end-loading and other fully-enclosed packages which are provided with opening panels and adapted to be joined together in side-by-side relationship so that the opening panels of several or all interconnected packages may be removed in one single operation and without separating the packages.

What I claim is:

1. A unitized shipping and display carton comprising a plurality of packages each having a top wall and a base interconnected by a pair of spaced side walls so as to form a tubular structure, end wall means to prevent endwise movement of the contents through the ends of said tubular structure, a removable opening panel provided in each top wall and extending at least partially in at least one of said side walls and defined by tear lines, characterised in that said packages are joined one to the next in side-by-side relationship at least along the side wall portions of said opening panels and in that said tear lines defining the top wall portion of the opening panel of one package are in registry with those of the next adjacent package whereby removal of the opening panel of an endmost package of said carton can be continued to cause removal of the opening panels of the other packages in said carton.

2. A carton according to claim 1, further characterised in that said opening panel is provided in the top wall and partially in each of the opposed side walls of each package.

3. A carton according to claim 1 or claim 2 further characterised in that at least one side wall of each package is provided with a glued area by which that package is secured to an adjacent package.

4. A carton according to claim 1, further characterised in that said end wall means comprises a panel at each corner of said tubular structure which panel has its opposite ends secured to portions of said top panel and said base such that each corner end wall is inclined outwardly of said tubular structure with respect to the adjacent ends of said side walls.

5. A carton according to claim 4, further characterised in that said end wall means incorporates a carrying handle at least at one end of the carton.

6. A carton according to claim 1, further characterised in that said packages are fully enclosed.

* * * * *